United States Patent [19]

Ayotte

[11] Patent Number: 4,890,839

[45] Date of Patent: Jan. 2, 1990

[54] ADJUSTABLE FRAME FOR PUZZLES

[76] Inventor: Erik Ayotte, 600 E. Lincoln, Madison Heights, Mich. 48071

[21] Appl. No.: 251,732

[22] Filed: Oct. 3, 1988

[51] Int. Cl.[4] ..... A63F 9/00

[52] U.S. Cl. ..... 273/157 R

[58] Field of Search ..... 273/157 R

[56] References Cited

U.S. PATENT DOCUMENTS

| | | | |
|---|---|---|---|
| 1,904,724 | 4/1933 | Gartland | 273/157 R |
| 2,003,072 | 5/1935 | Eynon | 273/157 R |
| 2,003,845 | 6/1935 | Whitcomb | 273/157 R |

OTHER PUBLICATIONS

"Jigsaw Puzzle Book", by Francene & Louis Sabin, publ. by Henry Regnery Co., Chicago, Ill., copyright 1977, pp. 70, 71.

*Primary Examiner*—Anton O. Oechsle

*Attorney, Agent, or Firm*—Dykema Gossett

[57] ABSTRACT

An adjustable frame for jig-saw puzzles defining the exterior parameters of the puzzle. Each side of the frame is made up of two or more members connected to each other by clamps that allow linear sliding of the members so as to make the frame independently adjustable as to length and width. A base member is connected to the bottom of the frame to provide a puzzle work surface.

8 Claims, 1 Drawing Sheet

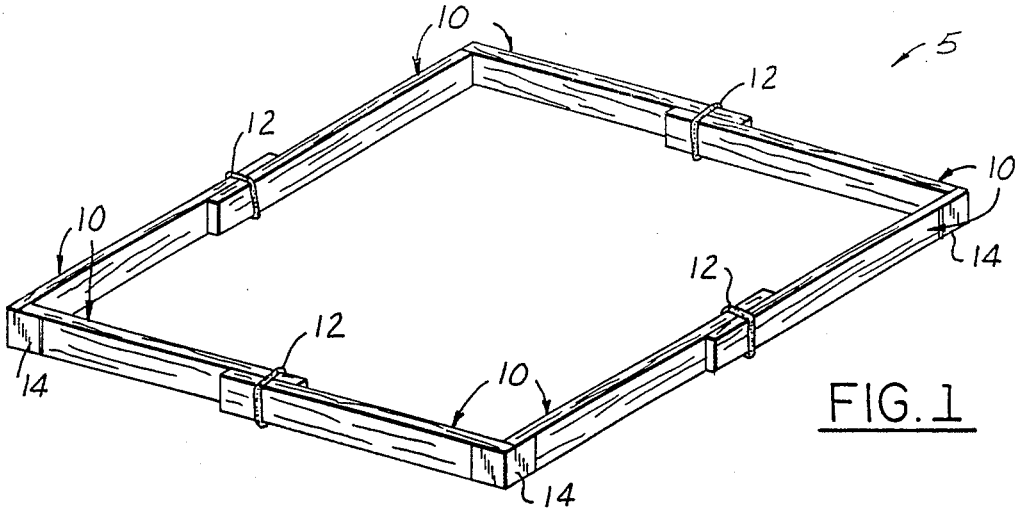
FIG. 1
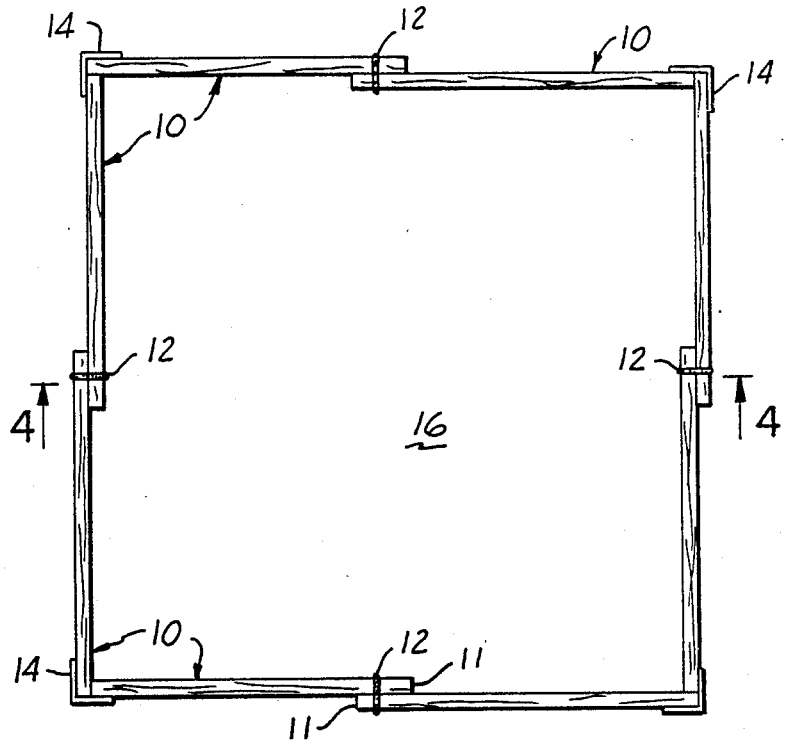
FIG. 2
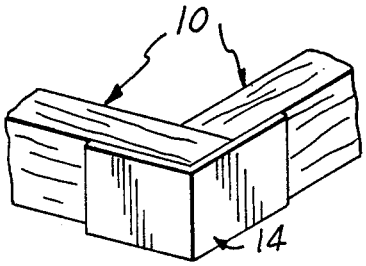
FIG. 3
FIG. 4
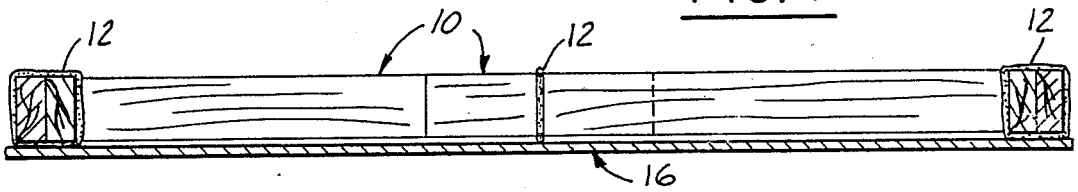

ADJUSTABLE FRAME FOR PUZZLES

FIELD OF THE INVENTION

The present invention relates generally to a frame for enclosing and protecting jig-saw puzzles during assembly. More particularly, the present invention relates to a frame for jig-saw puzzles that can be adjusted as to length of each side of the frame and can be easily assembled and disassembled for compact storage.

BACKGROUND OF THE INVENTION

A jig-saw puzzle consists of several irregular interlocking pieces which when properly fitted together form a picture or design. To facilitate assembly, the many pieces are spread out face-up on a flat surface. By comparison of their shapes and design, the individual pieces can be assembled to form the completed picture. Often, different portions of the puzzle are assembled simultaneously.

A puzzle, if not assembled at a single sitting, is often left unattended. The inventor, in observing his mother assemble many puzzles, became aware of the number of perils facing the partially completed, unattended puzzle. Small children or household pets, attracted by the brightly colored pieces, may knock the partially completed puzzle off the work surface, scattering the pieces across the floor. Similarly, an accidental bumping of the work surface may cause pieces to be disturbed.

An additional problem arises when assembling a puzzle on an open surface. When the exterior parameters of the completed puzzle are undefined on the work surface, it is difficult to position the partially assembled portions in proper relationship to one another. When the exterior parameter is defined on the work surface, it is possible to place the various partially completed portions in relationship to that defined parameter and, thus, in proper relationship to one another.

SUMMARY OF THE INVENTION

The present invention is an adjustable frame for enclosing and protecting the pieces of a jig-saw puzzle during assembly. The frame is adjustable so that it can be used for puzzles of various sizes. The frame also serves to define the exterior parameters of the completed puzzle.

In the disclosed embodiment, the frame is rectangular in shape with each side of the rectangle having at least two overlapping members. These overlapping members are attached by a clamp that allows the members to slide with respect to one another, thus increasing or decreasing the amount of overlap and decreasing or increasing the length of that side. It should be understood that other geometric shapes are within the intended scope of the present invention, including, but not limited to, triangles, circles, ovals, hexagons, octagons, etc.

The frame may also have a backing board attached to its underside. The puzzle, when fully completed may be sealed within the frame and on top of the backing, creating a completed assembly suitable for wall hanging, etc.

BRIEF DESCRIPTION OF THE DRAWINGS

FIG. 1 is a view in perspective of the preferred embodiment of the adjustable frame for puzzles showing a plurality of elongated members defining a rectangular area and the clamps attaching each pair of elongated members at their overlap.

FIG. 2 is a top view of the preferred embodiment of the adjustable frame for puzzles.

FIG. 3 is an enlarged view of a corner of the adjustable frame for puzzles, showing a bracket joining the members to form an included right angle.

FIG. 4 is a cross-sectional view along line 4—4 of FIG. 2.

DETAILED DESCRIPTION OF THE INVENTION

Referring to the drawings, the adjustable frame for puzzles of the present invention is shown generally at 5. Frame 5 includes a plurality of members 10 which are arranged to define a geometric configuration, which in this embodiment is illustrated as a rectangle or square. Each member 10 is adjustably connected to its adjacent member 10 at 11. See FIG. 2.

The connecting means in this embodiment is a clamp 12 which preferably is a rubber band that has been wrapped several times about the adjoining members. The rubber band clamp provides sufficient retention to clamp the adjoining members together when they are properly adjusted and permits easy adjustment of the adjoining members with respect to one another. To adjust the frame, the members 10 merely have to be pulled or pushed since the rubber band expands sufficiently to permit relative movement. It should be understood that other forms of clamps are within the intended scope of the invention including metal band type clamps, a lost motion slot with a clamping nut, etc. As is clear from FIGS. 1 and 3, the adjustability of the frame is found exclusively along the sides, while the corners of the frame remain fixed.

The disclosed embodiment of the invention is made up of eight elongated members 10. Each member 10 has a free-end 11 which overlaps the adjoining free-end 11 of an adjacent member 10. At the overlap 11, each pair of members 10 is connected by clamp 12. As discussed, clamp 12 is firm enough to maintain the relative position of members 10, while allowing linear sliding of members 10, creating the adjustability feature of the invention. The opposite ends of each member 10 are connected by a bracket 14 to create an included right angle. Brackets 14 may be made of cardboard, metal or any other suitable material.

As should be apparent, clamps 12 and brackets 14 may be easily removed to allow for disassembly of the invention and for storage. Because of the ease in assembly and storage, the invention is readily adapted for use as a insert in a puzzle box or in the alternative may be constructed from the puzzle box itself if appropriate perforations are provided in the box.

With reference to FIG. 2 a base member 16 is illustrated. Base 16 is in the shape of the defined area and may be attached to the bottom of the adjustable frame to provide a work surface. Upon completion of the jig-saw puzzle, a coating of sealant may be applied to the puzzle pieces to permanently fix the puzzle within the adjustable frame and base 16.

OPERATION

In operation, the adjustable puzzle frame 5 is assembled with the side members 10 adjustably clamped together by clamps 12. The outer perimeter of the unassembled puzzle is predetermined and the members are moved relative to each other to define this outer perimeter. In the disclosed embodiment, the members are merely pulled apart with the rubber band clamps expanding slightly to allow for relative movement. If during assembly of the puzzle, it is discovered that the outer perimeter of the puzzle is different, then the puzzle frame may be readjusted easily without disturbing the puzzle.

What is claimed is:

1. An adjustable frame for protecting and enclosing a puzzle of irregular interlocking pieces which when properly fitted together form a picture or the like, said adjustable frame defining the exterior parameters of the properly completed puzzle, said adjustable frame comprising:

a plurality of side members interconnected to define a geometric configuration, said geometric configuration having three or more interior acute angles, each of said angles being formed by two rigidly fixed, adjacent non-parallel side members; and means for adjustable interconnecting at least three of said side members to at least three adjacent parallel said side members such that said interconnected members may be moved with respect to one another at points other than at said acute interior angles;

whereby said frame may be adjusted to define variously sized geometric configurations and accommodate various sizes of puzzles by moving said adjustably connected side members with respect to one another, said side members being received entirely within, and not extending outwardly beyond, said geometric configuration.

2. A frame for puzzles as recited in claim 1, wherein said connecting means is a clamp, said clamp permitting independent sliding of said adjustably connected side members with respect to one another.

3. An adjustable frame for protecting and enclosing a puzzle of irregular interlocking pieces which when properly fitted together form a picture or the like, said adjustable frame defining the exterior parameters of a properly completed puzzle and comprising:

a first set of first and second members overlapping linearly at an end of each of said members to form a first side;

a second set of first and second members overlapping linearly at an end of each of said members of said second set to form a second side, the end opposite the overlap of the first member of said second side fixedly interconnected with the end opposite the overlap of the first member of said first side to form an included right angle;

a third set of elongated members having first and second members overlapping linearly at an end of each of said members of said third set to form a third side, the end opposite the overlap of the first member of said third side fixedly interconnected with the end opposite the overlap of the second member of said second side to form an included right angle;

a fourth set of elongated members having first and second members overlapping linearly at an end of each of said members of said fourth set to form a fourth side, the end opposite the overlap of the first of said members of said fourth side fixedly interconnected with the end opposite the overlap of the second of said members of said third side to form an included right angle and the second of said members of said fourth side fixedly interconnected with the second of said members of said first aide to form an included right angle; and a means for adjustably attaching each of said pairs of members of each of said sets at the points of said overlap so as to form a rectangular work area independently adjustable as to length and width while maintaining a constant relative positional relationship between each of said members interconnected to form each of said included right angles.

4. An adjustable frame for puzzles as recited in claim 3, wherein said connecting means is a clamp allowing independent linear sliding of each of said members of each of said pairs against the respective other said member of said pairs.

5. An adjustable frame for puzzles as recited in claim 4, wherein said clamps are easily removable from said overlapping members.

6. An adjustable frame for puzzles as recited in claim 5, wherein said clamps are bands of rubber.

7. An adjustable frame for puzzles as recited in claim 5, wherein said clamps are bands of metal.

8. An adjustable frame for puzzles as recited in claim 4, further comprising a bracket creating each of said interconnections forming an included right angle between each of said sides.

* * * * *